US007207516B2

(12) United States Patent
Sheelar

(10) Patent No.: US 7,207,516 B2
(45) Date of Patent: Apr. 24, 2007

(54) FENCE BUILDING TOOL AND METHOD OF USING THE SAME

(76) Inventor: Troy M. Sheelar, 220 County Rd. 325, George West, TX (US) 78022-3649

( * ) Notice: Subject to any disclaimer, the term of this patent is extended or adjusted under 35 U.S.C. 154(b) by 0 days.

(21) Appl. No.: 10/896,669

(22) Filed: Jul. 22, 2004

(65) Prior Publication Data

US 2005/0017231 A1 Jan. 27, 2005

Related U.S. Application Data

(60) Provisional application No. 60/489,571, filed on Jul. 23, 2003.

(51) Int. Cl.
*B65H 75/34* (2006.01)

(52) U.S. Cl. ..... 242/406

(58) Field of Classification Search ..... 256/47, 256/48, 11, 32, 52, 53, 57; 248/122.1, 304, 248/218.4, 370, 218.1, 415, 219.2
See application file for complete search history.

(56) References Cited

U.S. PATENT DOCUMENTS

| | | | | |
|---|---|---|---|---|
| 89,281 A | | 4/1869 | Bordner | |
| 305,776 A | | 9/1884 | Amstutz | |
| 591,803 A | | 10/1897 | Aylworth | |
| 2,163,954 A | * | 6/1939 | Lucas | 174/45 R |
| 2,791,841 A | | 5/1957 | Roenfeld | |
| 3,995,833 A | * | 12/1976 | McLaughlin et al. | 256/59 |
| 4,065,013 A | * | 12/1977 | Orthman | 414/607 |
| 4,408,748 A | * | 10/1983 | Lewis | 256/11 |
| 4,603,840 A | * | 8/1986 | Simkin | 256/11 |
| 5,662,313 A | * | 9/1997 | Forrester | 256/11 |
| 6,330,998 B1 | * | 12/2001 | Roy | 256/19 |

* cited by examiner

*Primary Examiner*—Daniel P. Stodola
*Assistant Examiner*—Joshua T. Kennedy
(74) *Attorney, Agent, or Firm*—G. Turner Moller

(57) ABSTRACT

A tool is provided to assist stringing fence wire during building of a fence. The tool comprises a hanger for suspending the tool from a secondary fence post, which is typically a metal T-post. An upright attaches to the hanger and provides a series of arms extending away from the fence post. The arms include an end structure that support fence wire against downward movement and against movement away from the fence post, all in an effort to minimize entangling of wire before it is tightened. After the fence wire is tightened, the tools are removed from the fence post and may be reused. Several different types of end structures are provided.

19 Claims, 1 Drawing Sheet

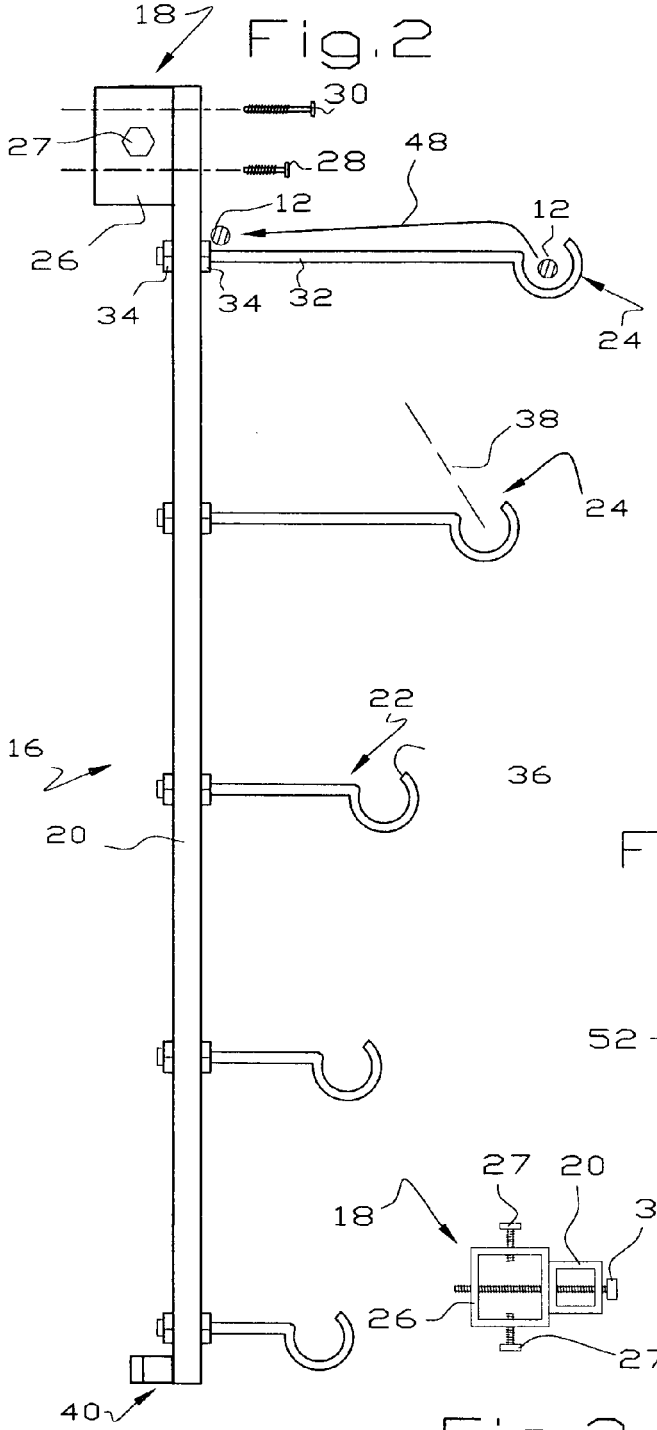
Fig.2
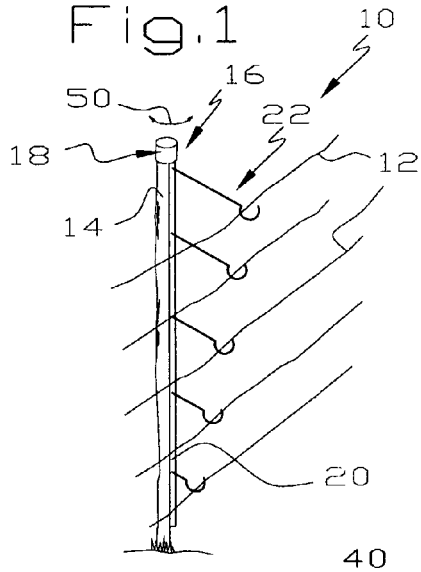
Fig.1
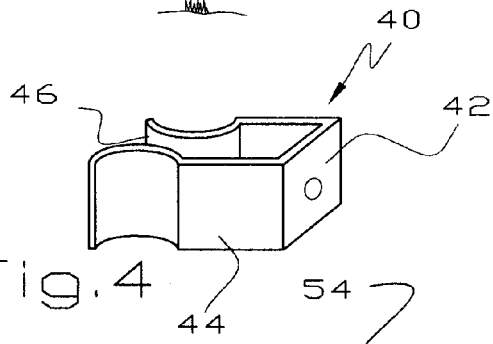
Fig.4
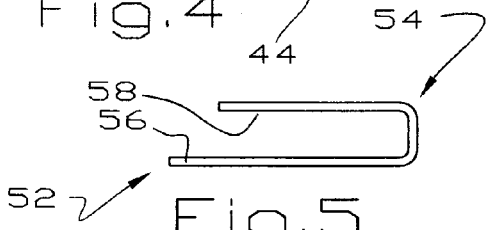
Fig.5
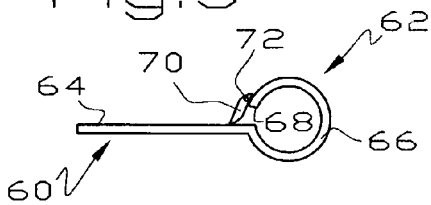
Fig.6
Fig.3
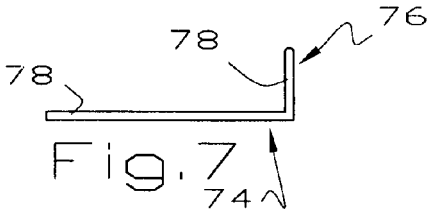
Fig.7

FENCE BUILDING TOOL AND METHOD OF USING THE SAME

This application is based on provisional application Ser. No. 60/489,571, filed Jul. 23, 2003, entitled MULTIPURPOSE FENCING TOOL, and priority thereon is hereby claimed.

This invention is a fence building tool, and more particularly, a tool for stringing elongate fence materials between fence posts.

BACKGROUND OF THE INVENTION

When building wire fence, either barbed wire or electric wire, a number of strands are permanently attached to a sturdy fence post at one end of a run and then loosely strung along the fence row toward a second sturdy fence post. At the second fence post, a conventional tensioning device is used to tighten each wire so all of the wires are under substantial tension and the end of the wire is permanently attached to the second sturdy fence post.

If two people are working on the fence, one person operates the tensioning device and the other walks along the fence row, making sure that the wires are not entangled, either with each other or with bushes, branches, limbs or the like in the right of way. If only one person is working on the fence, the person tightening the wires walks down the fence row after the wires are tightened, checking to see that the wires are parallel and adjacent the fence posts. Almost invariably, one finds that two of the wires have become entangled or one of the wires has become entangled with a bush, branch, limb or the like. This requires the person to walk back to the tensioning device, loosen the entangled wire, walk back to where the entanglement occurred, separate the wires, walk back to the tensioning device and retension the wires while hoping that they do not become entangled again.

When the wires have been appropriately tightened and attached to the second fence post, the builder or builders then attach the wires to the secondary fence posts between the end posts. If the secondary posts are wooden, the tightened wires are attached to the secondary posts with staples. Modern wire fence uses metal posts, called T-posts, for the secondary posts. Barbed wire is attached to the T-posts with clips or ties made for this purpose. Electric wire is supported on secondary posts by insulating attachments.

Disclosures of interest relative to this invention are found in U.S. Pat. Nos. 89,281; 305,776; 591,803 and 2,791,841.

SUMMARY OF THE INVENTION

It has become apparent that something is needed to assist in the stringing of fence wire so that it does not become entangled during the tightening process. In particular, an efficient wire stringing tool is a great advantage to a one man fence builder because it avoids the problem of wire becoming entangled in the process of being tightened and the resultant additional effort required to untangle and retighten the wire or wires.

In this invention, a fence building or wire stringing tool is temporarily placed on posts along the fence row. The tools of this invention are not placed on every post, and some judgment about spacing is required. Typically, the wire stringing tools are suspended on secondary fence posts every 50–150' along the fence row. The wire stringing tool comprises a hanger for suspending the tool on the fence post, an upright and a series of arms projecting away from the upright to temporarily hold wire in preparation for tightening. If desired, an attachment may be provided to hold a lower end of the upright.

After the wires have been tightened and permanently attached to the sturdy end post, the wire stringing tools of this invention are removed from the secondary fence posts and the wires are attached to the secondary fence posts in a conventional manner.

It is an object of this invention to provide an improved fence building tool for stringing fence wire.

A further object of this invention is to provide a wire stringing tool which is temporarily suspended from a fence post to hold wire strung along the fence row and minimize entangling of the wire during the process of tightening the wires.

A more specific object of this invention is to provide a wire stringing tool having a series of arms of different length projecting away from an upright temporarily suspended from a fence post to minimize entangling of the wire.

These and other objects and advantages of this invention will become more apparent as this description proceeds, reference being made to the accompanying drawings and appended claims.

BRIEF DESCRIPTION OF THE DRAWINGS

FIG. 1 is a partial isometric view of a fence being built using the tool of this invention;

FIG. 2 is a side elevational view of the tool of this invention;

FIG. 3 is a top view of the tool of FIG. 2 illustrating another feature of this invention;

FIG. 4 is an isometric view of a clip used to attach the lower part of the tool to the fence post;

FIG. 5 is a partial side elevational view of another end structure of the arms of the tool of FIG. 2;

FIG. 6 is a partial side elevational view of another end structure of the arms of the tool of FIG. 2; and FIG. 7 is a partial side elevational view of another end structure of the arms of the tool of FIG. 2; and

DETAILED DESCRIPTION

Referring to FIGS. 1–3, there is illustrated a fence 10 in the process of being built. A series of wires 12 have been attached to a sturdy fence post (not shown) on one side of a secondary post 14 on which is temporarily mounted a fence building or wire stringing tool 16 of this invention. The tool 16 comprises, as major components, a hanger 18 for suspending the tool from the post 14, an upright 20 connected to the hanger 18 and a series of arms 22 extending away from the upright 20. The arms 22 each include an end structure 24 for partially constraining movement of the wires 12. Specifically, the end structures 24 prevent downward movement of the wires 12 and at least partially prevent movement of the wires 12 away from the upright 20.

The hanger 18 may be of any suitable type, depending at least partially on the type of secondary post 14. If the posts 14 are wooden, it may be desired to provide a bracket (not shown) which may be nailed to the top of the post 14. A preferred version of this invention is designed to be employed with metal T-posts, so the hanger 18 is preferably a sleeve 26 having an open bottom of sufficient inside size to receive the top of the post 14 and having some type structure, as discussed below, so the tool 16 is supported on the top of the post 14. The sleeve 26 is conveniently of square metal tubing. As will be more fully apparent hereinafter, a pair of fasteners 27 may be provided to temporarily secure the tool 16 to the post 14 as shown best in FIG. 3. To this end, the fasteners 27 extend through opposite sides of the sleeve 26 to contact the fence post 14 and thereby prevent the tool 16 from moving relative to the post 14.

The upright 20 may be of any suitable type and provides a support for the arms 22. Conveniently, the upright 20 is of a smaller square metal tubing than the sleeve 26. The upright 20 may be welded to the sleeve 26 or connected thereto by suitable threaded fasteners 28, 30. The upper threaded fastener 30 may be of sufficient length to extend across the sleeve 26 and thereby block the end of the sleeve 26 so the tool 16 is supported on the fastener 30. In a welded version of the tool 16, the sleeve 26 is welded to the upright 16 and an endcap (not shown) is provided on the upper end of the sleeve 26.

The arms 22 have two purposes—to support the wire 12 in preparation for tightening in such a manner that the wires 12 do not become entangled and also to allow the wires 12 to be tightened in a conventional manner so they end up adjacent the post 14 in response to the tightening process. To this end, the arms 22 include a section 32, one end of which is attached to the upright 20 in any suitable manner, such as by welding or by the use of nuts 34 threaded on the end of the sections 32. The sections 32 are preferably horizontal but may be appropriately inclined if desired. As will be more fully pointed out hereinafter, the sections 32 are preferably of different length to position the wires 12 at different distances from the upright 20 thereby spacing the wires 12 as far apart from each other as is practical and thereby minimizing entanglement of the wires 12 before and during tightening.

The end structures 24 constrain the wires 12 against movement downwardly and against movement away from the upright 20. A preferred version of the end structures 24 is shown in FIG. 2 where the end structure is an upwardly open C, the opening 36 having an opening axis 38 inclined upwardly toward the upright 20. Preferably, the C-shaped end structure 24 provides some constraint against upward movement and yet allows movement of the wire 12 out of the end structure 24 during tightening. Thus, one may make the opening 36 smaller so the wire 12 is less likely to inadvertently come out of the end structure 24 but if one makes it too small, it become difficult to thread the wire 12 into the end structure and may provide some impediment of the wire 12 moving out of the end structure 24 during tightening.

Although not essential, it may be desirable to provide some mechanism to temporarily attach a lower end of the upright 20 to the post 14. To this end, a clip 40 is provided as shown in FIGS. 2 and 4. The clip 40 is of conventional design and includes a base 42 for attachment, either by welding or with fasteners, to the back of the upright 20, a pair of resilient arms 44 extending away from the base 42 and a pair of inwardly convex cam type ends 46 which cam open the arms 44 when the clip 40 is pressed onto the T-posts 14.

An important feature of this invention is that the arms 22 hold the wires 12 at different distances from the upright 20. This acts to separate the wires 12 further and thereby minimize entanglements of the wires 12 with each other. It will accordingly be apparent that the wires 12 in FIG. 2 are progressively further from the upright as one proceeds upwardly. It will also be apparent that many other spacings are equally, or perhaps more, effective. For example, it may be that staggering the length of the arms 22 may be more effective. The fact that the tool 16 supports the wires 12 off the ground acts to minimize entanglements of the wires 12 with low lying obstacles on the right of way.

Use of the tool 16 of this invention should now be apparent. A pair of sturdy fence posts are buried in the earth at the ends of a fence row and a series of secondary posts 14 are driven into the ground along the fence row between the sturdy end posts. The wires 12 are then permanently secured to one of the sturdy posts (not shown) and then strung along the fence row. A tool 16 of this invention is placed on selected secondary posts at a desired interval, typically 50–150' apart, using the clip 40 on the lower end of the upright 20, if desired, to attach the lower end of the upright 20 to the post 14. Preferably, the fasteners 27 are tightened against the post 12 to secure the tool 16 to the post 12. The wires 12 in the process of being strung are passed into the end structure 24 so they are supported in a spaced apart position as shown in FIG. 1 and constrained against movement as may be induced by the inherent metal memory of the wire, it having been unrolled from a cylindrical spool.

The wires 12 are strung until they reach the second sturdy end post. The wires 12 are separately tightened, or ganged together and tightened together, with a conventional tensioning device. As each wire 12 is tightened, it naturally becomes shorter and moves out of the end structure 24 in the direction of the arrow 48 until it comes to rest adjacent the upright 20 as shown in FIG. 2. After all of the wires 12 are tightened, the fence builder moves down the fence row, removes each of the tools 16 from the secondary posts 14 by unclipping the clip 40, loosening the fasteners 27 and rotating the tool 16 as suggested by the arrow 50 in FIG. 1. The wires 12 are then secured to the posts 14 in a conventional manner.

Referring to FIG. 5, another arm 52 is illustrated with a different end structure 54. The arm 52 includes a section 56 secured to the upright 20 in any suitable manner, such as by welding or the use of threaded fasteners. The section 56 also acts to constrain movement of the wire against downward movement. The end structure 54 is of U-shape having an opening 58 facing toward the upright. It will accordingly be seen that the shape of the arm 52 provides considerably more constraint against movement of the wire than does the end structure 24.

Referring to FIG. 6, another arm 60 is illustrated with a different end structure 62. The arm 60 includes a section 64 secured to the upright 20 in any suitable manner, such as by welding or the use of threaded fasteners. The end structure 62 includes a generally C-shaped member 66 having an opening 68 facing toward the upright 20, the opening 68 being closed by a gate 70 pivoted about a pin 72 and biased by a spring (not shown) toward the closed position shown in FIG. 6. In use, the fence builder has to hold the gate 70 open and insert the wire into the C-shaped member 66. Despite this disadvantage and the disadvantage of greater complexity, the end structure 62 has the advantage of providing maximum protection against wire entanglement.

Referring to FIG. 7, another arm 74 is illustrated with a different end structure 76. The arm 74 includes a section 78 secured to the upright 20 in any suitable manner, such as by welding or the use of threaded fasteners. The section 78 also acts to constrain movement of the wire against downward movement. The end structure 76 is a simple generally vertical member 78 constraining the wire against movement away from the upright 20.

Referring to FIGS. 2 and 3, another use of this invention involves the construction of game fencing, hog fencing, panel fencing, no climb fencing or the like in which the fence material incorporates panels, rolls or sheets of fence material providing intersecting horizontal and vertical wire. Building fence with this type material also requires that the fence material be tightened so it lies adjacent the post 14 where it is clipped or otherwise attached to the post 14. The tool 16 is suitable for holding this type fence material upright adjacent the fence post. With this type fence material, the fasteners 27 are not tightened against the post 12. Instead, the fasteners 27 are removed or are not tightened against the post 14 thus allowing the sleeve 26 and thus the tool 16 to rotate relative to the fence post 14 when the fence material is tightened. This is necessary or desirable because, otherwise, the vertical wire of the fence material contacts the arms 24 and thus prevents complete tightening of the fence material.

It will be apparent that the tool 16 has other analogous uses. It can be used, like some of the prior art devices, to hold fence boards in position so they may be nailed appropriately on a post.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A use and remove fence building tool comprising an upright for hanging adjacent a fence post of a generally planar fence, a hanger for supporting the upright on the fence post, the hanger comprising a sleeve for receiving the fence post, and a series of arms secured to and extending away from the upright, each having end structure for constraining movement of wire against downward movement and against movement away from the upright thereby minimizing entangling of the wire during installation and also allowing the wire to move toward the upright when the wire is tightened, the sleeve free of inwardly projecting obstructions thereby providing an interior of a sufficient inside size to receive the fence post and allow rotation of the hanger relative to the fence post from a first position where the arms are generally perpendicular to the planar fence to a second offset angular position sufficient to allow the arms to disengage a tensioned wire.

2. The use and remove fence building tool of claim 1 wherein the arms comprise a first end secured to the upright at vertically spaced locations and second ends providing the end structure, the arms being of different length.

3. The use and remove fence building tool of claim 2 wherein the arms are progressively longer.

4. The use and remove fence building tool of claim 3 wherein longer arms are higher up on the upright.

5. The use and remove fence building tool of claim 1 wherein the end structure comprises an upwardly facing C.

6. The use and remove fence building tool of claim 5 wherein the upwardly facing C has an opening providing an opening axis, the opening axis being inclined toward the upright.

7. The use and remove fence building tool of claim 1 wherein the end structure comprises a U having an open side facing toward the upright.

8. The use and remove fence building tool of claim 1 wherein the end structure comprises a closed structure having a gate allowing wire movement into and out of the closed structure.

9. The use and remove fence building tool of claim 1 wherein the end structure comprises a bottom member and a terminal upwardly extending angled member merging with the bottom member.

10. The use and remove fence building tool of claim 1 wherein the end structure has a means for partially constraining movement of the wire toward the upright.

11. The use and remove fence building tool of claim 1 wherein the hanger comprises an open bottom sleeve for receiving an upper end of the fence post and at least one adjustably move mounted projection movable from a position blocking rotation of the sleeve relative to the fence post to a position allowing rotation of the sleeve relative to the fence post.

12. The use and remove fence building tool of claim 11 wherein the adjustably mounted projection comprises a threaded fastener for temporarily securing the sleeve to the fence post.

13. The use and remove tool of claim 11 wherein the hanger comprises square tubing.

14. The use and remove fence building tool of claim 1 wherein the sleeve interior has a sufficient inside size to allow rotation of from the first position to a position generally parallel to the planar fence.

15. The use and remove fence building tool of claim 14 wherein the sleeve has a sufficient inside size to allow movement on the fence post in an arc of at least 90°.

16. A use and remove fence building tool comprising an upright for hanging adjacent a fence post of a generally planar fence, a hanger for supporting the upright on the fence post, the hanger comprising a sleeve for receiving the fence post, at least one retractable abutment movable between a first position extending into the interior of the sleeve for preventing rotation of the hanger relative to the fence post and a second position allowing rotation of the hanger relative to the fence post, and a series of arms secured to and extending away from the upright, each having end structure for constraining movement of wire against downward movement and against movement away from the upright thereby minimizing entangling of the wire during installation and also allowing the wire to move toward the upright when the wire is tightened, the sleeve free of inwardly projecting obstructions thereby providing an interior of a sufficient inside size to receive the fence post, with the abutment in the second position, and allow rotation of the hanger relative to the fence post from a first position where the arms are generally perpendicular to the planar fence to a second offset angular position sufficient to allow the arms to disengage a tensioned wire.

17. The use and remove fence building tool of claim 16 wherein the retractable abutment comprises a threaded fastener.

18. The use and remove fence building tool of claim 16 wherein the sleeve interior has a sufficient inside size to allow rotation of from the first position to a position generally parallel to the planar fence.

19. The use and remove fence building tool of claim 18 wherein the sleeve has a sufficient inside size to allow movement on the fence post for an arc of at least 90°.

* * * * *